US009811040B2

(12) United States Patent
Muto

(10) Patent No.: US 9,811,040 B2
(45) Date of Patent: Nov. 7, 2017

(54) IMAGE FORMING SYSTEM PERFORMING PREDETERMINED PROCESSING WITHIN A CERTAIN AMOUNT OF TIME AFTER PREPARATION OPERATION, IMAGE FORMING APPARATUS, AND STORAGE MEDIUM

(71) Applicant: Konica Minolta, Inc., Tokyo (JP)

(72) Inventor: Ryosuke Muto, Hachioji (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/270,535

(22) Filed: Sep. 20, 2016

(65) Prior Publication Data

US 2017/0090384 A1 Mar. 30, 2017

(30) Foreign Application Priority Data

Sep. 29, 2015 (JP) ..... 2015-190711

(51) Int. Cl.
*G03G 15/00* (2006.01)
*G03G 21/14* (2006.01)

(52) U.S. Cl.
CPC ..... *G03G 15/6529* (2013.01); *G03G 15/5062* (2013.01); *G03G 21/14* (2013.01); *G03G 2215/00569* (2013.01)

(58) Field of Classification Search
CPC . G03G 15/6529; G03G 15/5062; G03G 21/14
USPC ..... 399/15
See application file for complete search history.

(56) References Cited

U.S. PATENT DOCUMENTS 8,855,505 B2 * 10/2014 Yano ..... G03G 15/5062 399/15
9,310,741 B2 * 4/2016 Matsui et al. ..... G03G 15/5062
2006/0023245 A1 2/2006 Sato et al.

FOREIGN PATENT DOCUMENTS

JP 2000-177921 A 6/2000
JP 2005-323059 A 11/2005
JP 2006-035751 A 2/2006
JP 2007-201605 A 8/2007
JP 2014-219525 A 11/2014
(Continued)

OTHER PUBLICATIONS

Notification of Refusal dated Aug. 8, 2017 issued by the Japanese Patent Office in corresponding Japanese Patent Application No. 2015-190711 and English language translation (20 pages).

*Primary Examiner* — William J Royer
(74) *Attorney, Agent, or Firm* — Buchanan Ingersoll & Rooney PC

(57) ABSTRACT

An image forming system includes an image forming apparatus which forms an image on a sheet; and a sheet processing apparatus which includes a processing device which performs predetermined processing on a sheet conveyed from the image forming apparatus. The processing device is able to perform the predetermined processing within a certain amount of time after preparation operation to enable the predetermined processing is completed. The sheet processing apparatus includes a processor which controls timing to start the preparation operation so that the preparation operation is completed when a first sheet which is to be a target of the predetermined processing reaches the processing device.

12 Claims, 8 Drawing Sheets

(56) References Cited

FOREIGN PATENT DOCUMENTS

| | | | |
|---|---|---|---|
| JP | 2015-004811 | A | 1/2015 |
| JP | 2015-030221 | A | 2/2015 |

* cited by examiner

FIG. 4

261

| | SHEET FEEDING TRAY | | | | | | | |
|---|---|---|---|---|---|---|---|---|
| | T1 | T2 | T3 | T4 | T5 | T6 | T7 | T8 |
| SHEET FEEDING TIME, SECONDS | 4 | 4 | 6 | 6 | 6 | 9 | 9 | 9 |

FIG. 5

262

| | ADJUSTMENT TYPE | | | | |
|---|---|---|---|---|---|
| | NO ADJUSTMENT | COLOR REGISTRATION ADJUSTMENT | GAMMA ADJUSTMENT | CHARGE POTENTIAL ADJUSTMENT | TONER DENSITY ADJUSTMENT |
| ADJUSTMENT TIME, SECONDS | 0 | 30 | 45 | 10 | 60 |

FIG. 6

263

| | SHEET TYPE | | |
|---|---|---|---|
| | THIN SHEET | NORMAL SHEET | THICK SHEET |
| IMAGE FORMING TIME, SECONDS | 3 | 3 | 4 |

FIG. 7

264

| | APPARATUS CONNECTION CONFIGURATION | | |
|---|---|---|---|
| | DIRECT CONNECTION WITH MAIN BODY | MAIN BODY + SHEET INSERTING APPARATUS + SHEET PROCESSING APPARATUS | MAIN BODY + HUMIDIFIER + SHEET PROCESSING APPARATUS |
| CONVEYING TIME, SECONDS | 9 | 16 | 15 |

FIG. 8

265

| | COLORIMETRIC MODE | |
|---|---|---|
| | NORMAL COLORIMETRIC MODE | FINE COLORIMETRIC MODE |
| PREPARATION OPERATION TIME, SECONDS | 6 | 10 |

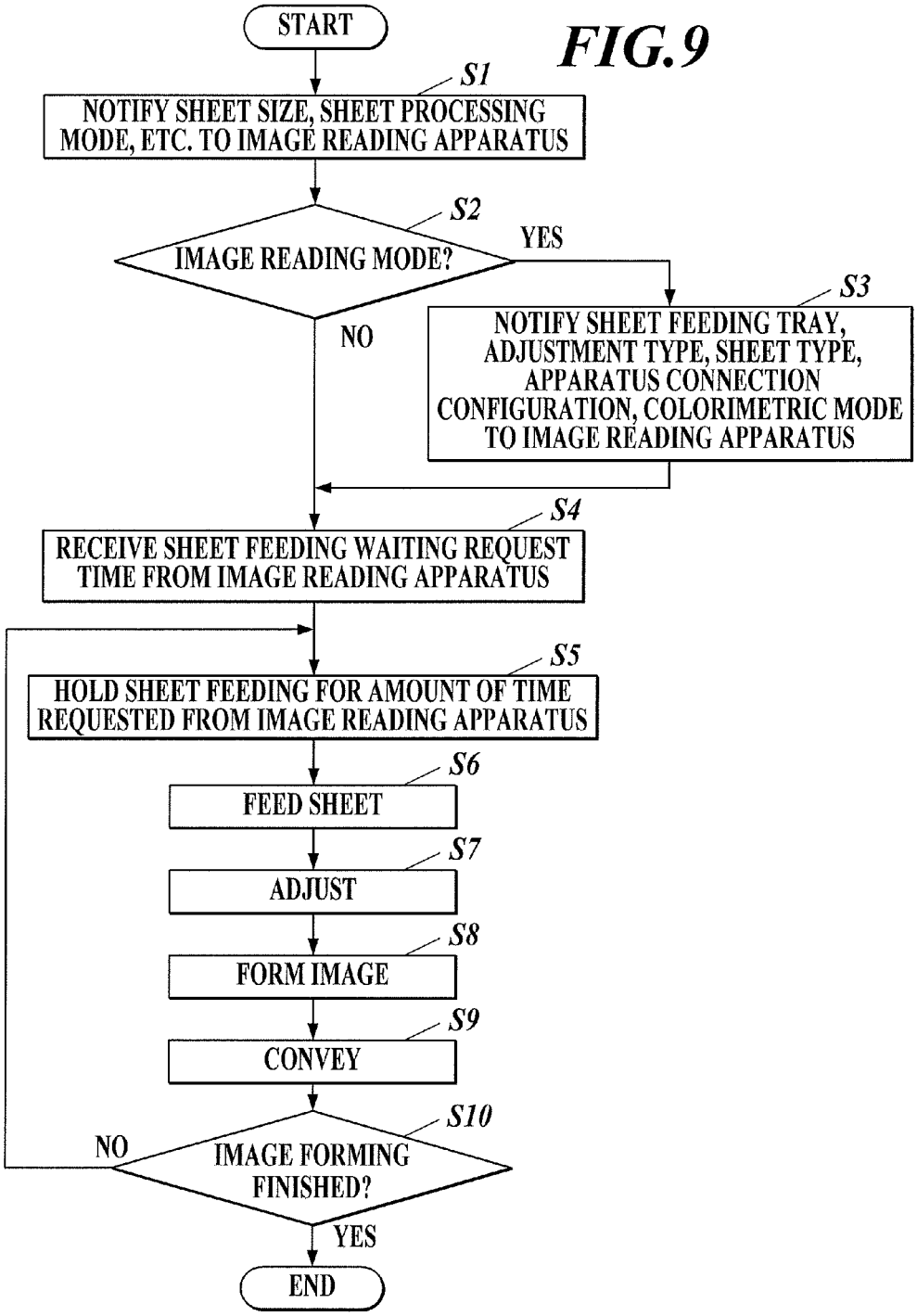
FIG.9
START
S1
NOTIFY SHEET SIZE, SHEET PROCESSING MODE, ETC. TO IMAGE READING APPARATUS
S2
IMAGE READING MODE?
YES
NO
S3
NOTIFY SHEET FEEDING TRAY, ADJUSTMENT TYPE, SHEET TYPE, APPARATUS CONNECTION CONFIGURATION, COLORIMETRIC MODE TO IMAGE READING APPARATUS
S4
RECEIVE SHEET FEEDING WAITING REQUEST TIME FROM IMAGE READING APPARATUS
S5
HOLD SHEET FEEDING FOR AMOUNT OF TIME REQUESTED FROM IMAGE READING APPARATUS
S6
FEED SHEET
S7
ADJUST
S8
FORM IMAGE
S9
CONVEY
S10
IMAGE FORMING FINISHED?
NO
YES
END

IMAGE FORMING SYSTEM PERFORMING PREDETERMINED PROCESSING WITHIN A CERTAIN AMOUNT OF TIME AFTER PREPARATION OPERATION, IMAGE FORMING APPARATUS, AND STORAGE MEDIUM

BACKGROUND OF THE INVENTION

Field of the Invention

The present invention relates to an image forming system, an image forming apparatus, and a storage medium.

Description of Related Art

In a conventionally used image forming system, a sheet processing apparatus which performs stapling, folding, cutting, etc. on a sheet after image forming is connected to an image forming apparatus which forms an image on a sheet.

In such image forming system including an image forming apparatus and a sheet processing apparatus, the image forming apparatus conveys sheets to follow to the sheet processing apparatus while maintaining an interval with forwarded sheets on which certain processing needs to be performed in the sheet processing apparatus. If the image forming apparatus is able to convey the sheets while maintaining an interval no smaller than the interval notified by the sheet processing apparatus, jamming due to the sheets bumping is not caused. With this, the sheet processing apparatus is able to perform predetermined processing.

For example, Japanese Patent Application Laid-Open Publication No. 2000-177921 discloses in a post-processing apparatus including a binding unit, there is a technique to control the interval between the last sheet of a previous bundle and the first sheet of the next bundle considering conveying time of the binding unit which changes according to the interval between the binding positions.

Japanese Patent Application Laid-Open Publication No. 2005-323059 discloses when the post-processing mode is switched, there is a technique to control the interval between the last sheet before changing and the first sheet after changing based on the switching time set in advance for each combination of the post-processing mode before changing and the post-processing mode after changing.

Among the processing performed by the sheet processing apparatus there is processing that needs preparation operation before starting the processing. In the sheet processing apparatus, the necessary preparation operation is performed as fast as possible so that the sheet processing apparatus is promptly in a state to be able to receive sheets from the image forming apparatus. With this, jamming is prevented.

For example, in the sheet processing apparatus, in order to measure the color using a colorimeter, preparation operation such as "white calibration" and "pre-luminescence" needs to be performed. The "white calibration" is processing to read the white surface for calibration (calibration surface) with the colorimeter to determine a reference value of the colorimeter. The "pre-luminescence" is processing in which the LED (Light Emitting Diode) used as the light source in the colorimeter is lit for a predetermined amount of time to stabilize the amount of light.

However, when the colorimeter is used, since the amount of light decreases due to the heat of the LED, the color needs to be measured within a certain amount of time after the preparation operation is completed in order to properly measure the color. When a certain amount of time passes, the preparation operation needs to be done again.

When the color is measured using the colorimeter and the image is formed while maintaining the quality of the shade in the image forming system including the image forming apparatus and the sheet processing apparatus, if the "white calibration" and the "pre-luminescence" as the preparation operation is performed as fast as possible, the color cannot be measured until the first sheet is conveyed to the position of the colorimeter. Therefore, the number of sheets with which the color can actually be measured decreases and productivity decreases.

FIG. 12 shows a state of a colorimeter and a state of the conveyed sheet in each position when the color is measured in the conventional image forming system. The number in each position shows the number of the sheet counted from the first sheet. The horizontal axis shows the time. Here, after the preparation operation (white calibration and pre-luminescence) is completed, the color can be measured for 37 seconds.

In such system, in order to convey the sheet from the sheet feeding start position of the image forming apparatus to the resist position, through the sheet ejecting position and then to the position of the colorimeter, 16 seconds is necessary. Since the preparation operation (white calibration and pre-luminescence) consumes 6 seconds, the color can be measured 6 seconds after the first sheet is fed, but even after the color can be measured the color is not measured for 10 seconds. This results in bad productivity.

In this case, after measuring the color of the 14th sheet which is when the certain amount of time in which the color can be measured ends, the preparation needs to be performed again, and the 15th sheet needs to wait in the image forming apparatus for the amount of time necessary to complete the preparation.

BRIEF SUMMARY OF THE INVENTION

The present invention has been made in consideration of the above problems, and one of the main objects is to enhance productivity of predetermined processing performed within a certain amount of time after preparation is completed.

In order to achieve at least one of the above-described objects, according to an aspect of the present invention, there is provided an image forming system including: an image forming apparatus which forms an image on a sheet; and a sheet processing apparatus which includes a processing device which performs predetermined processing on a sheet conveyed from the image forming apparatus, wherein, the processing device is able to perform the predetermined processing within a certain amount of time after preparation operation to enable the predetermined processing is completed; and the sheet processing apparatus includes a processor which controls timing to start the preparation operation so that the preparation operation is completed when a first sheet which is to be a target of the predetermined processing reaches the processing device.

Preferably, in the image forming system, the processing device reads an image formed on the sheet conveyed from the image forming apparatus.

Preferably, in the image forming system, the processing device is a colorimeter which measures color of the image formed on the sheet conveyed from the image forming apparatus; and the preparation operation is white calibration on the colorimeter and pre-luminescence of an optical source of the colorimeter.

Preferably, in the image forming system, the processor determines the timing to start the preparation operation based on timing that the first sheet reaches the processing device and amount of time necessary to perform the preparation operation.

Preferably, in the image forming system, the processor predicts the timing that the first sheet reaches the processing device based on at least one of a sheet feeding tray used in the image forming apparatus, a type of adjustment performed in the image forming apparatus, a sheet type or an apparatus connection configuration.

BRIEF DESCRIPTION OF THE DRAWINGS

The present invention will become more fully understood from the detailed description given hereinbelow and the appended drawings, and thus are not intended to define the limits of the present invention, and wherein;

FIG. 4 is a diagram showing an example of a sheet feeding tray-sheet feeding time corresponding table;

FIG. 5 is a diagram showing an example of adjustment type-adjustment time corresponding table;

FIG. 6 is a diagram showing an example of sheet type-image forming time corresponding table;

FIG. 7 is a diagram showing an example of apparatus connection configuration-conveying time corresponding table;

FIG. 8 is a diagram showing an example of a colorimetric mode-preparation operation time corresponding table;

FIG. 9 is a flowchart showing a process performed in an image forming apparatus;

DETAILED DESCRIPTION OF PREFERRED EMBODIMENTS

An embodiment of the image forming system of the present invention is described with reference to the drawings. The present invention is not limited to the illustrated example.

Figure 1:
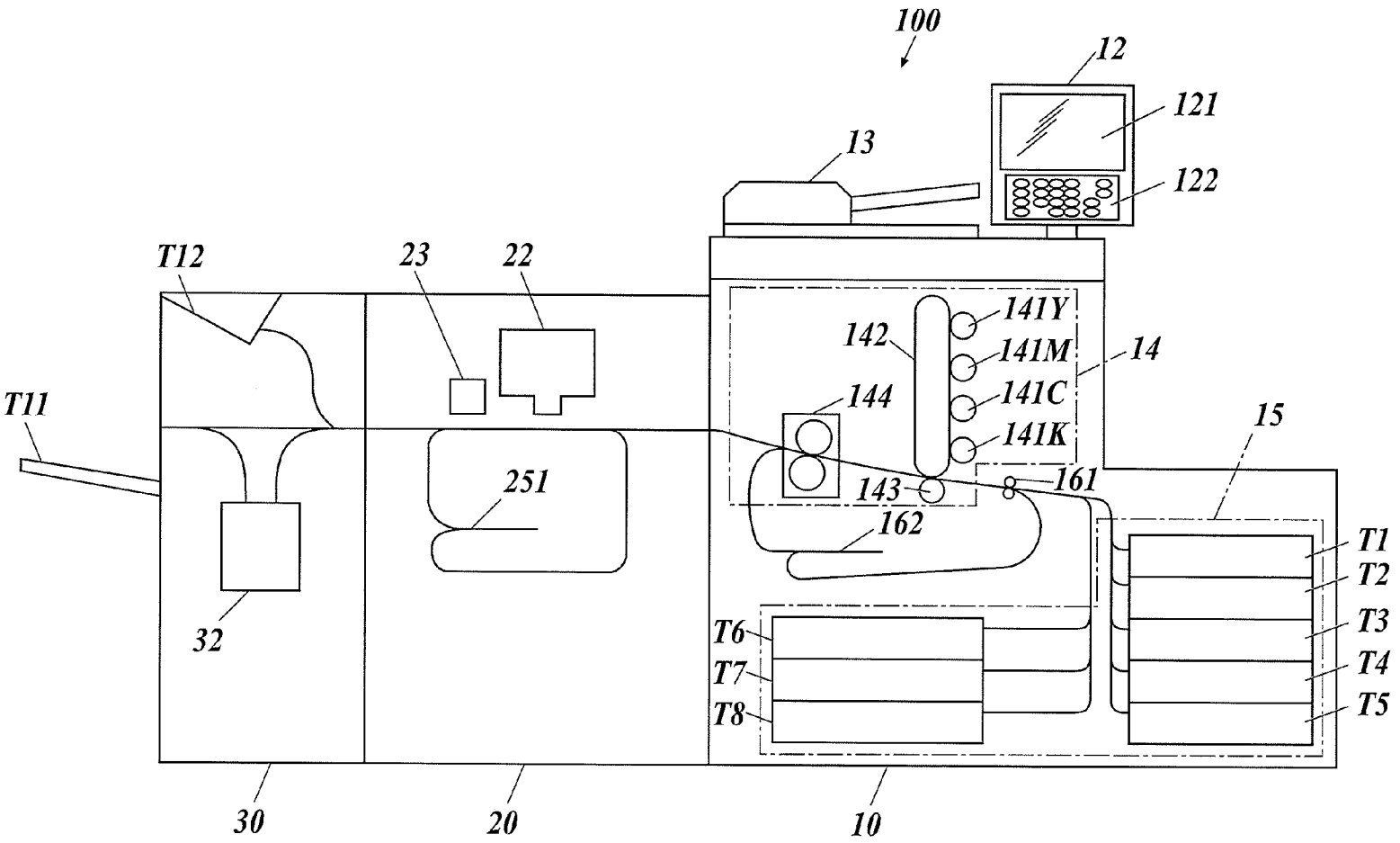
FIG. 1 is a diagram showing a schematic configuration of an image forming system regarding an embodiment of the present invention.

FIG. 1 is a drawing of a schematic configuration of an image forming system 100.

As shown in FIG. 1, the image forming system 100 includes an image forming apparatus 10, an image reading apparatus 20 as a sheet processing apparatus, and a saddle stitching apparatus 30. There is connection to enable data communication between the image forming apparatus 10 and the image reading apparatus 20, and the image reading apparatus 20 and the saddle stitching apparatus 30.

The image forming apparatus 10 forms a color image on a sheet by electrophotography based on image data obtained by reading an image from a document or image data received from an external apparatus.

The image forming apparatus 10 includes an operation/display unit 12, a scanner 13, an image forming unit 14, a sheet feeder 15, a registration roller 161, a reversing mechanism 162 and the like.

The operation/display unit 12 includes a display 121 and an operation unit 122.

Figure 3:
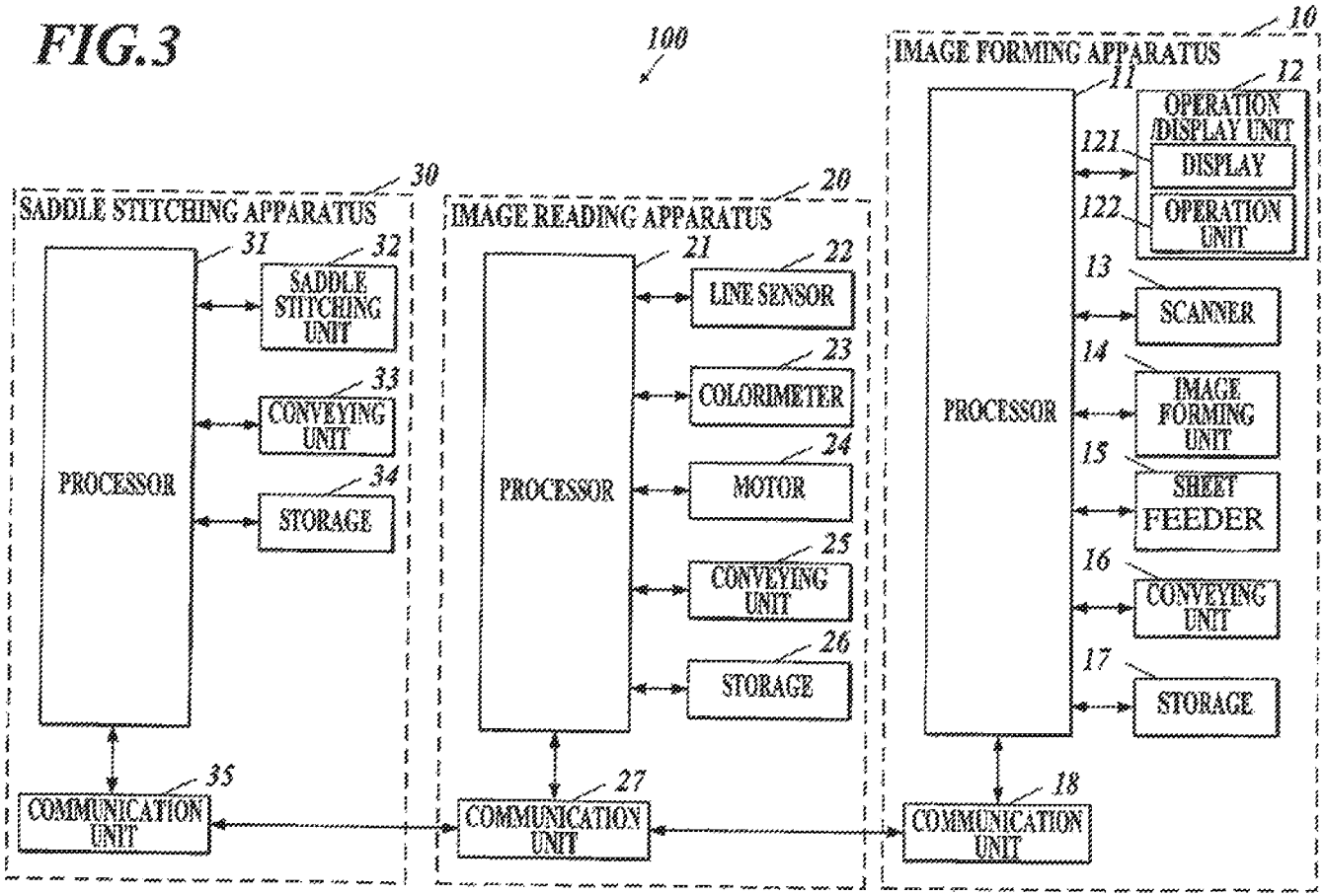
FIG. 3 is a block diagram showing a functional configuration of apparatuses of an image forming system.

The display 121 includes an LCD (Liquid Crystal Display) and displays various screens according to display signals as instructions input from a processor 11 (see FIG. 3).

The operation unit 122 includes a touch panel formed so as to cover the display screen of the display 121 and various operation buttons such as numeric buttons, start button, etc., and outputs the operation signal according to the operation by the user to the processor 11.

The scanner 13 includes an optical source, a CCD (Charge Coupled Device) image sensor, an A/D convertor, etc. The light from the optical source scans the document and the reflected light is imaged. The image of the document is read by photoelectric conversion, and A/D conversion is performed on the read image. The obtained image data is output to the processor 11.

The image forming unit 14 forms an image on a sheet supplied from the sheet feeder 15 based on the image data obtained from the scanner 13 or the image data received from the external apparatus.

The image forming unit 14 includes photoreceptor drums 141Y, 141M, 141C, and 141K corresponding to yellow (Y), magenta (M), cyan (C), and black (K) respectively, intermediate transfer belt 142, secondary transfer roller 143, fixing unit 144, and the like.

After the photoreceptor drum 141Y is charged entirely, the photoreceptor drum 141Y is scanned and exposed with a laser beam based on the image data for yellow and an electrostatic latent image is formed. Then, the yellow toner is attached to the electrostatic latent image on the photoreceptor drum 141Y and the image is developed.

With the exception of the color being different, the description of the photoreceptor drum 141Y also applies to the photoreceptor drums 141M, 141C, and 141K, and thus, the description is omitted.

The toner images of each color formed on the photoreceptor drums 141Y, 141M, 141C, and 141K are sequentially transferred on the rotating intermediate transfer belt 142 (primary transfer). That is, the color toner image with the toner images of 4 colors overlapped on one another is formed on the intermediate transfer belt 142.

The sheet supplied from the sheet feeder 15 is sent by the registration roller 161 to the secondary transfer roller 143 so that the image forming position and the sheet position match. The color toner image on the intermediate transfer belt 142 is transferred collectively on the sheet by the secondary transfer roller 143 (secondary transfer).

The fixing unit 144 includes a heating roller which heats the sheet on which the color toner image is transferred and a pressurizing roller which applies pressure to the sheet and fixes the color toner image on the sheet by applying heat and pressure.

When images are formed on both faces of the sheet, the reversing mechanism 162 flips the sheet to show the other surface.

The sheet feeder 15 includes sheet feeding trays T1 to T8 and supplies the sheet to the image forming unit 14. The sheet feeding trays T1 to T8 each store the sheet type and the sheet size predetermined for each sheet feeding tray.

The image reading apparatus 20 reads the image formed on the sheet conveyed from the image forming apparatus 10 according to necessity.

The image reading apparatus 20 includes a line sensor 22, a colorimeter 23 as a processing device and a reversing mechanism 251, etc.

The line sensor 22 is an array of CCD's aligned in the main scanning direction (direction orthogonal to the sheet conveying direction and direction parallel to the sheet surface) in the entire width of the image formed to read a one-dimensional image. The line sensor 22 reads the image according to the timing that the sheet on which the image is formed is conveyed to obtain the image data of the two dimensional image formed on the sheet. The line sensor 22 outputs the obtained image data to a processor 21 (see FIG. 3). The line sensor 22 is used to examine the position, color, dirt, etc. of the image formed on the sheet by the image forming unit 14.

As the predetermined processing, the colorimeter 23 performs the process to read the image formed on the sheet conveyed from the image forming apparatus 10. The colorimeter 23 is a spectrophotometric colorimeter which detects the spectral reflectivity for each wavelength from the image formed on the sheet and measures the color of the image. The colorimeter 23 reads the image on the sheet and outputs the obtained colorimetric data to the processor 21. The colorimetric data is used in the image forming apparatus 10 for color adjustment, gamma adjustment, toner density adjustment, etc. for the image. The image read by the colorimeter 23 includes, for example, a color patch, a gradation pattern, etc. for each color.

Figure 2A:
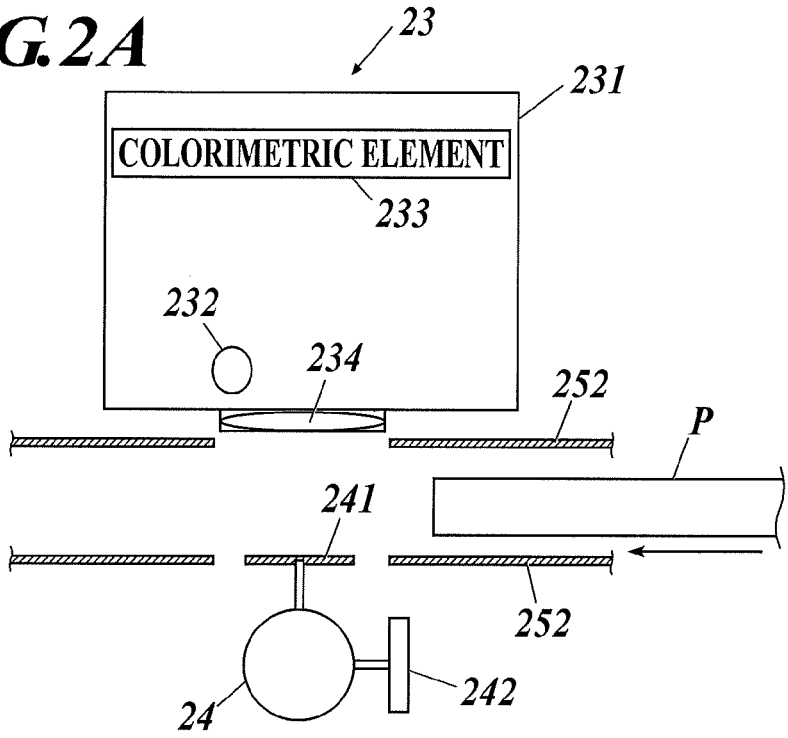
FIG. 2A is a diagram showing a configuration of a colorimeter when the sheet is conveyed, and peripherals of the colorimeter.
Figure 2B:
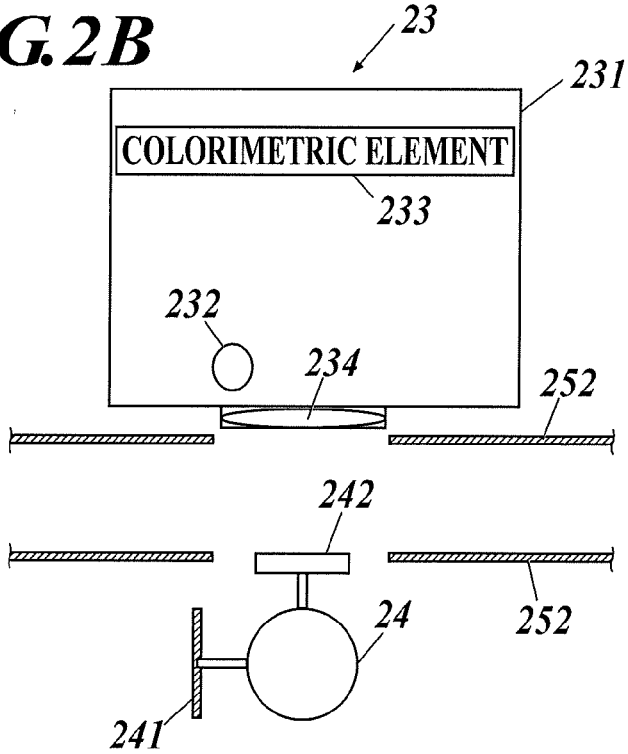
FIG. 2B is a diagram showing a configuration of a colorimeter in calibration, and peripherals of the colorimeter.

FIG. 2A and FIG. 2B show a configuration of the colorimeter 23 and its peripheral.

The colorimeter 23 is provided along a sheet conveying path 252 and includes an LED 232 as an optical source, a colorimetric element 233, a lens 234, etc. inside an exterior 231.

As shown in FIG. 2A, when a sheet P is conveyed to the sheet conveying path 252, the conveying face 241 is positioned to face a reading face of the colorimeter 23.

When the color is measured, the LED 232 irradiates light to the sheet P.

The colorimetric element 233 receives the light which is reflected on the sheet P through the lens 234, and outputs the colorimetric value (XYZ value, L*a*b* value, etc.) according to the spectral reflectivity for each wave length to the processor 21.

As shown in FIG. 2B, when calibration of the colorimeter 23 is performed, a calibration face 242 is positioned facing the reading face of the colorimeter 23. The calibration face 242 includes a plate which is to be the reference of white for the colorimeter 23.

When calibration of white is performed, the colorimeter 23 reads the calibration face 242 and outputs the read result to the processor 21. The processor 21 calibrates the output value of the colorimeter 23 based on the read result of the calibration face 242.

In order to enable measurement of color with the colorimeter 23, the white calibration on the colorimeter 23 and the pre-luminescence of the LED 232 in the colorimeter 23 needs to be performed as preparation operation. The "white calibration" is a process to read the calibration face 242 with the colorimeter 23 and to determine the reference value of the colorimeter 23. The "pre-luminescence" is a process to light the LED 232 for a predetermined amount of time so that the amount of light becomes stable.

The colorimeter 23 is able to measure the color only within a certain amount of time after the preparation operation is complete.

The conveying face 241 and the calibration face 242 are switched by the rotation of a motor (driving body) 24. The conveying face 241 faces the sheet conveying path 252 when the sheet P is conveyed so that the calibration face 242 does not become dirty or damaged (see FIG. 2A).

When the image on both faces of the sheet P is read by the line sensor 22 and the colorimeter 23, the reversing mechanism 251 reverses the sheet face.

The saddle stitching apparatus 30 performs a saddle stitching process as necessary on the sheet conveyed from the image reading apparatus 20.

The saddle stitching apparatus 30 includes a saddle stitching unit 32, sheet ejecting trays T11 and T12, etc.

The saddle stitching unit 32 folds the sheet inward (in half) and binds a predetermined number of overlapped sheets folded inward and binds the sheet to make a saddle stitched book.

The sheet ejecting tray T11 ejects the saddle stitched book made by the saddle stitching unit 32 or the bundle of sheets which passed the saddle stitching apparatus 30 without performing the saddle stitching process. The sheet ejecting tray T12 ejects the bundle of sheets which passed the saddle stitching apparatus 30 without performing the saddle stitching process.

FIG. 3 is a block diagram showing a functional configuration of each apparatus of the image forming system 100.

As shown in FIG. 3, the image forming apparatus 10 includes the processor 11, the operation/display unit 12, the scanner 13, the image forming unit 14, the sheet feeder 15, a conveying unit 16, a storage 17, a communication unit 18, etc. The description of the functions already described is omitted.

The processor 11 includes a CPU (Central Processing Unit), a ROM (Read Only Memory), a RAM (Random Access Memory), etc. The CPU reads out various processing programs stored in the ROM and deploys the above in the RAM. The processor 11 centrally controls the operation of each unit of the image forming apparatus 10 according to the deployed program.

The conveying unit 16 includes a conveying roller to convey the sheet. The conveying unit 16 supplies the sheet from the sheet feeder 15 to the image forming unit 14, and conveys the sheet in the image forming apparatus 10 until the sheet on which the image is formed is ejected to the image reading apparatus 20. The conveying unit 16 includes the registration roller 161 and the reversing mechanism 162.

The storage 17 includes a nonvolatile storage device such as a hard disk or a flash memory. The storage 17 stores various data. For example, the storage 17 stores various setting information. The setting information includes sheet size, sheet processing mode, sheet feeding tray to be used, type of adjustment, type of sheet (sheet type), apparatus connection configuration, colorimetric mode, etc.

The sheet processing mode is information showing the sheet processing (image reading process, saddle stitching process, etc.) performed in the image reading apparatus 20 and the saddle stitching apparatus 30.

The apparatus connection configuration is information showing a state of connection of the apparatuses from the image forming apparatus 10 to the image reading apparatus 20 (sheet processing apparatus which performs a predetermined process which can be performed only within a certain amount of time after the preparation is completed).

The colorimetric mode is a reading mode (normal colorimetric mode, fine colorimetric mode) performed when the color is measured with the colorimeter 23.

The communication unit 18 transmits and receives data to and from the external apparatuses connected to the communication network such as the LAN (Local Area Network), etc. and the image reading apparatus 20.

The processor 11 performs image quality adjustment based on the data obtained from the image read by the image reading apparatus 20. For example, the processor 11 corrects the shift in position, the shift in color, etc. of the image based on the image data obtained by the line sensor 22. The processor 11 performs color adjustment, gamma adjustment, toner density adjustment etc. of the image based on the colorimetric data obtained by the colorimeter 23.

The image reading apparatus 20 includes the processor 21, the line sensor 22, the colorimeter 23, the motor 24, a conveying unit 25, a storage 26, a communication unit 27, etc. The description of the functions already described is omitted.

The processor 21 includes a CPU, a ROM, a RAM, etc. The CPU reads out various processing programs stored in the ROM and deploys the above in the RAM, and centrally controls the operation of each unit of the image reading apparatus 20 according to the deployed program.

The motor 24 moves the conveying face 241 and the calibration face 242 so that each face faces the reading face of the colorimeter 23.

The conveying unit 25 includes a conveying roller to convey the sheet and conveys the sheet in the image reading apparatus 20 from when the sheet conveyed from the image forming apparatus 10 passes the reading position of the line sensor 22 and the colorimeter 23 until the sheet is discharged to the saddle stitching apparatus 30. The conveying unit 25 includes the reversing mechanism 251.

The storage 26 includes a nonvolatile storage device such as a hard disk or flash memory and stores the various data. For example, the storage 26 stores a sheet feeding tray-sheet feeding time corresponding table 261 (FIG. 4), an adjustment type-adjustment time corresponding table 262 (FIG. 5), a sheet type-image forming time corresponding table 263 (FIG. 6), an apparatus connection configuration-conveying time corresponding table 264 (FIG. 7), and a colorimetric mode-preparation operation time corresponding table 265 (FIG. 8).

FIG. 4 shows an example of the sheet feeding tray-sheet feeding time corresponding table 261. In the sheet feeding tray-sheet feeding time corresponding table 261, the sheet feeding time is corresponded to each of the sheet feeding trays T1 to T8. The sheet feeding time is the time from when the sheet is fed from the sheet feeding tray to when the sheet tip is conveyed to the position of the registration roller 161. For example, the sheet feeding time when the sheet is fed from the sheet feeding tray T1 is 4 seconds.

FIG. 5 shows an example of the adjustment type-adjustment time corresponding table 262. In the adjustment type-adjustment time corresponding table 262, the adjustment time is corresponded to each type of adjustment performed in the image forming apparatus 10 (no adjustment, color registration adjustment, gamma adjustment, charge potential adjustment, toner density adjustment, etc.). The adjustment time is the time necessary for the adjustment performed in the image forming apparatus 10. For example, the adjustment time when the color registration adjustment is performed in the image forming apparatus 10 is 30 seconds.

FIG. 6 shows an example of the sheet type-image forming time corresponding table 263. In the sheet type-image forming time corresponding table 263, the image forming time is corresponded with the sheet type (thin sheet, normal sheet, thick sheet, etc.). Here, as the image forming time, the time from when the tip of the sheet is sent out from the registration roller 161 to when the tip of the sheet is ejected from the image forming apparatus 10 is used. For example, when the sheet type is the thin sheet, the image forming time is 3 seconds.

FIG. 7 shows an example of the apparatus connection configuration-conveying time corresponding table 264. The apparatus connection configuration-conveying time corresponding table 264 corresponds the conveying time to the sheet processing apparatus with the apparatus connection configuration (direct connection to main body, main body+sheet inserting apparatus+sheet processing apparatus, main body+humidifier+sheet processing apparatus, etc.). The conveying time is the time from when the tip of the sheet is ejected from the image forming apparatus 10 (main body) until the sheet reaches the sheet processing apparatus. According to the present embodiment, the conveying time is to be the time from when the tip of the sheet is ejected from the image forming apparatus 10 to when the image as the colorimetric target formed on the sheet reaches the position to measure the color with the colorimeter 23 of the image reading apparatus 20. For example, when the image forming apparatus 10 and the image reading apparatus 20 are connected with the sheet inserting apparatus in between, the conveying time is 16 seconds.

FIG. 8 shows an example of the colorimetric mode-preparation operation time corresponding table 265. In the colorimetric mode-preparation operation time corresponding table 265, the preparation operation time is corresponded to the colorimetric mode (normal colorimetric mode, fine colorimetric mode, etc.). The preparation operation time is the amount of time necessary for the preparation operation. For example, the preparation operation time when the normal colorimetric mode is specified is 6 seconds.

The communication unit 27 transmits and receives data to and from the image forming apparatus 10 and the saddle stitching apparatus 30.

The processor 21 controls the timing to start the preparation operation so that the preparation operation is complete when the first sheet which is the target of color measurement conveyed from the image forming apparatus 10 reaches the colorimeter 23. The processor 21 predicts the timing that the first sheet reaches the colorimeter 23 based on the sheet feeding tray used in the image forming apparatus 10, the type of adjustment performed in the image forming apparatus 10, the sheet type, and the apparatus connection configuration. Then, the processor 21 determines the timing to start the preparation operation based on the timing that the first sheet reaches the colorimeter 23, the amount of time necessary for the preparation operation, etc.

The processor 21 transmits the image data obtained from the line sensor 22 and the colorimetric data obtained from the colorimeter 23 to the image forming apparatus 10 through the communication unit 27. The data transmitted from the image reading apparatus 20 to the image forming apparatus 10 does not have to be the data obtained from reading the image and can be any data which can be used to adjust the image quality in the image forming apparatus 10.

The saddle stitching apparatus 30 includes a processor 31, the saddle stitching unit 32, a conveying unit 33, a storage 34, a communication unit 35, etc. The description of the functions already described is omitted.

The processor 31 includes a CPU, a ROM, a RAM, etc. The CPU reads out various processing programs stored in the ROM and deploys the above in the RAM. According to the deployed program, the CPU centrally controls the operation of each section in the saddle stitching apparatus 30.

The conveying unit 33 includes a conveying roller to convey the sheet, and conveys the sheet in the saddle stitching apparatus 30 from when the sheet is conveyed from the image reading apparatus 20 to when the sheet is ejected to the sheet ejecting trays T11 and T12.

The storage 34 includes a nonvolatile storage apparatus such as a hard disk, flash memory, etc. and stores various data.

The communication unit 35 transmits and receives data to and from the image reading apparatus 20.

Next, the operation of the image forming system 100 of the present embodiment is described.

FIG. 9 is a flowchart showing a process performed in the image forming apparatus 10. The process is a process performed with an instruction to start image forming, and is a software process performed by the CPU of the processor 11 in coordination with the program stored in the ROM.

The processor 11 notifies data such as sheet size, sheet processing mode, etc. to the image reading apparatus 20 through the communication unit 18 (step S1).

Next, the processor 11 determines whether the image reading mode is specified (step S2). The image reading mode is the mode in which the colorimeter 23 measures the color.

When the image reading mode is specified (step S2; YES), the processor 11 notifies the sheet feeding tray used in the image forming apparatus 10, the adjustment type performed in the image forming apparatus 10, the sheet type, the apparatus connection configuration, and the colorimetric mode to the image reading apparatus 20 through the communication unit 18 (step S3).

After step S3 or in step S2, when the image reading mode is not specified (step S2; NO), the communication unit 18 receives the sheet feeding waiting request time from the image reading apparatus 20 (step S4). The sheet feeding waiting request time is the waiting time for each sheet requested based on the sheet processing performed in the image reading apparatus 20 and the saddle stitching apparatus 30. In step S4, the sheet feeding waiting request time for each of the plurality of sheets fed successively is received.

Based on the sheet feeding waiting request time for the sheet to be fed, the processor 11 holds the sheet feeding for the amount of time requested from the image reading apparatus 20 (step S5).

Next, the processor 11 controls the sheet feeder 15 and the conveying unit 16 and feeds the sheet from the specified sheet feeding tray (step S6).

Next, the processor 11 performs the specified adjustment (step S7). When no adjustment is specified, the adjustment is not performed.

Next, the processor 11 controls the image forming unit 14 and the conveying unit 16, and forms the image on the sheet based on the image data of the image forming target (step S8).

Next, the processor 11 controls the conveying unit 16 and conveys the sheet to the image reading apparatus 20 (step S9).

Here, the processor 11 determines whether the image forming ends (step S10). When the image forming is not finished (step S10; NO), the processor 11 returns to step S5 and repeats the process.

In step S10, when the image forming ends (step S10; YES), the process in the image forming apparatus 10 ends.

Figure 10:
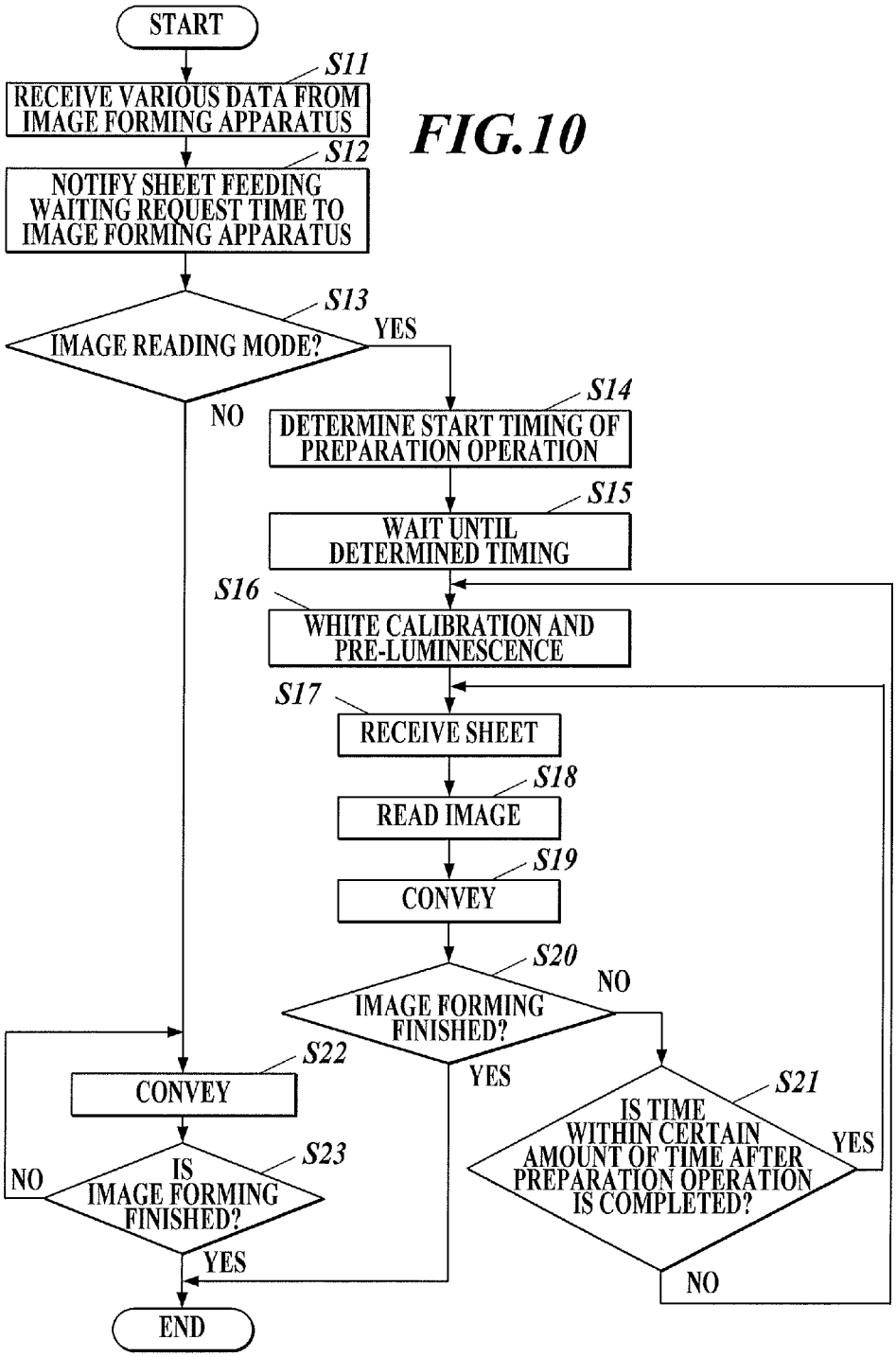
FIG. 10 is a flowchart showing a process performed in an image reading apparatus.

FIG. 10 is a flowchart showing the process performed in the image reading apparatus 20. The process is realized by software processing performed by the CPU of the processor 21 in coordination with the program stored in the ROM.

First, the communication unit 27 receives various data from the image forming apparatus 10 (step S11). Specifically, the communication unit 27 receives data such as sheet size, sheet processing mode, etc. transmitted in step S1. When the image reading mode is specified, the communication unit 27 further receives the sheet feeding tray, the adjustment type, the sheet type, the apparatus connection configuration, and the colorimetric mode transmitted in step S3.

Next, based on the sheet size and the sheet processing mode, the processor 21 calculates the sheet feeding waiting request time for each of the plurality of sheets fed successively and notifies the sheet feeding waiting request time to the image forming apparatus 10 through the communication unit 27 (step S12).

Next, the processor 21 determines whether the image reading mode is specified (step S13).

When the image reading mode is specified (step S13; YES), the processor 21 determines the start timing of the preparation operation (step S14). Specifically, based on the timing that the first sheet reaches the colorimeter 23 and the time necessary for the preparation operation, the timing to start the preparation operation is determined.

The timing to start the preparation operation is determined from the following equation.

Waiting time until the start of preparation operation (sheet feeding time+adjustment time+image forming time+conveying time)−preparation operation time The (sheet feeding time+adjustment time+image forming time+conveying time) corresponds to the time from when the first sheet is fed to when the sheet reaches the colorimeter 23. That is, the time is the predicted value of timing for the first sheet to reach the colorimeter 23.

For example, an example of color measurement in the normal colorimetric mode using the normal sheet in the A3 size stored in the sheet feeding tray T1 without performing adjustment in the image forming apparatus 10 is described. The apparatus connection configuration in the image forming system 100 is main body (image forming apparatus 10)+sheet processing apparatus (image reading apparatus 20)+saddle stitching apparatus 30, and the image reading apparatus 20 is directly connected to the main body.

The processor 21 refers to the sheet feeding tray−sheet feeding time corresponding table 261 (see FIG. 4) and obtains the sheet feeding time corresponding to the sheet feeding tray to be used. The sheet feeding time when the sheet is fed from the sheet feeding tray T1 is 4 seconds.

The processor 21 refers to the adjustment type-adjustment time corresponding table 262 (see FIG. 5) and obtains the adjustment time corresponding to the adjustment type performed in the image forming apparatus 10. The adjustment time when the adjustment is not performed in the image forming apparatus 10 is 0 seconds.

The processor 21 refers to the sheet type-image forming time corresponding table 263 (see FIG. 6) and obtains the image forming time corresponding to the sheet type. The image forming time when the sheet type is the normal sheet is 3 seconds.

The processor 21 refers to the apparatus connection configuration-conveying time corresponding table 264 (see FIG. 7) and obtains the conveying time corresponding to the apparatus connection configuration. The conveying time when the image reading apparatus 20 is directly connected to the main body is 9 seconds.

The processor 21 refers to the colorimetric mode-preparation operation time corresponding table 265 (see FIG. 8) and obtains the preparation operation time corresponding to the colorimetric mode. The preparation operation time when the colorimetric mode is the normal colorimetric mode is 6 seconds.

The waiting time until the start of the preparation operation can be obtained by the following equation.

The waiting time until the start of the preparation operation=(4+0+3+9)−6=10 (seconds)

Next, the processor 21 waits for the determined timing to start the preparation operation (step S15).

Next, the processor 21 performs the white calibration and pre-luminescence (step S16). Specifically, the processor 21 controls the motor 24 so that the colorimeter 23 reads the calibration face 242 in the state with the calibration face 242 facing the reading face of the colorimeter 23, and calibrates the colorimeter 23 based on the read result. The processor 21 controls the LED 232 of the colorimeter 23 to emit light for a predetermined amount of time (for example, 2 seconds) so that the amount of light from the LED 232 is stable.

Next, the processor 21 controls the conveying unit 25 to receive the sheet conveyed from the image forming apparatus 10 (step S17), so that the colorimeter 23 reads the image formed on the sheet (color measurement) (step S18). The processor 21 transmits the colorimetric data obtained by measuring the color to the image forming apparatus 10 through the communication unit 27.

The processor 21 controls the conveying unit 25 to convey the sheet after the image is read to the saddle stitching apparatus 30 (step S19).

Here, the processor 21 determines whether the image forming ended in the image forming apparatus 10 (step S20).

When the image forming is not finished (step S20; NO), the processor 21 determines whether it is within a certain time from when the preparation operation (white calibration and pre-luminescence) of step S16 finished (step S21).

When it is within a certain amount of time from when the preparation operation finished (step S21; YES), the processor 21 returns to step S17 and repeats the processing.

In step S21, when it is past the certain amount of time from when the preparation operation finished (step S21; NO), the process returns to step S16 and the processor 21 performs control to perform the preparation operation again.

In step S13, when the image reading mode is not specified (step S13; NO), the processor 21 controls the conveying unit 25 and conveys the sheet in the image reading apparatus 20 to the saddle stitching apparatus 30 (step S22).

Here, the processor 21 determines whether the image forming ended in the image forming apparatus 10 (step S23).

When the image forming is not finished (step S23; NO), the processor 21 returns to step S22 and repeats the processing.

When the image forming ends in step S20 (step S20; YES) or when the image forming ends in step S23 (step S23; YES), the processing in the image reading apparatus 20 ends.

Figure 11:
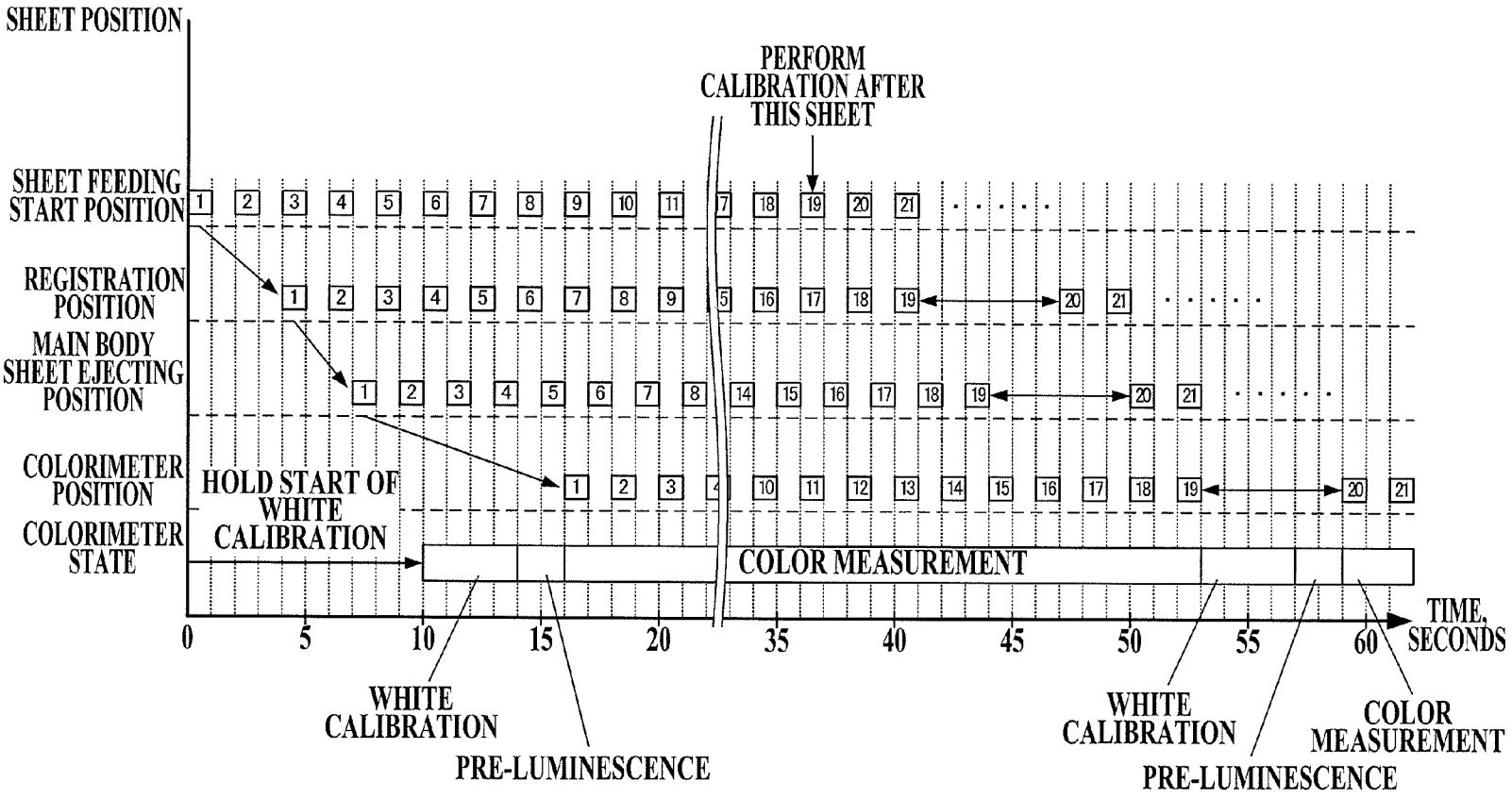
FIG. 11 is a processing image showing a state of a conveyed sheet in each position and showing a state of the colorimeter when the color is measured in the image forming system.
Figure 12:
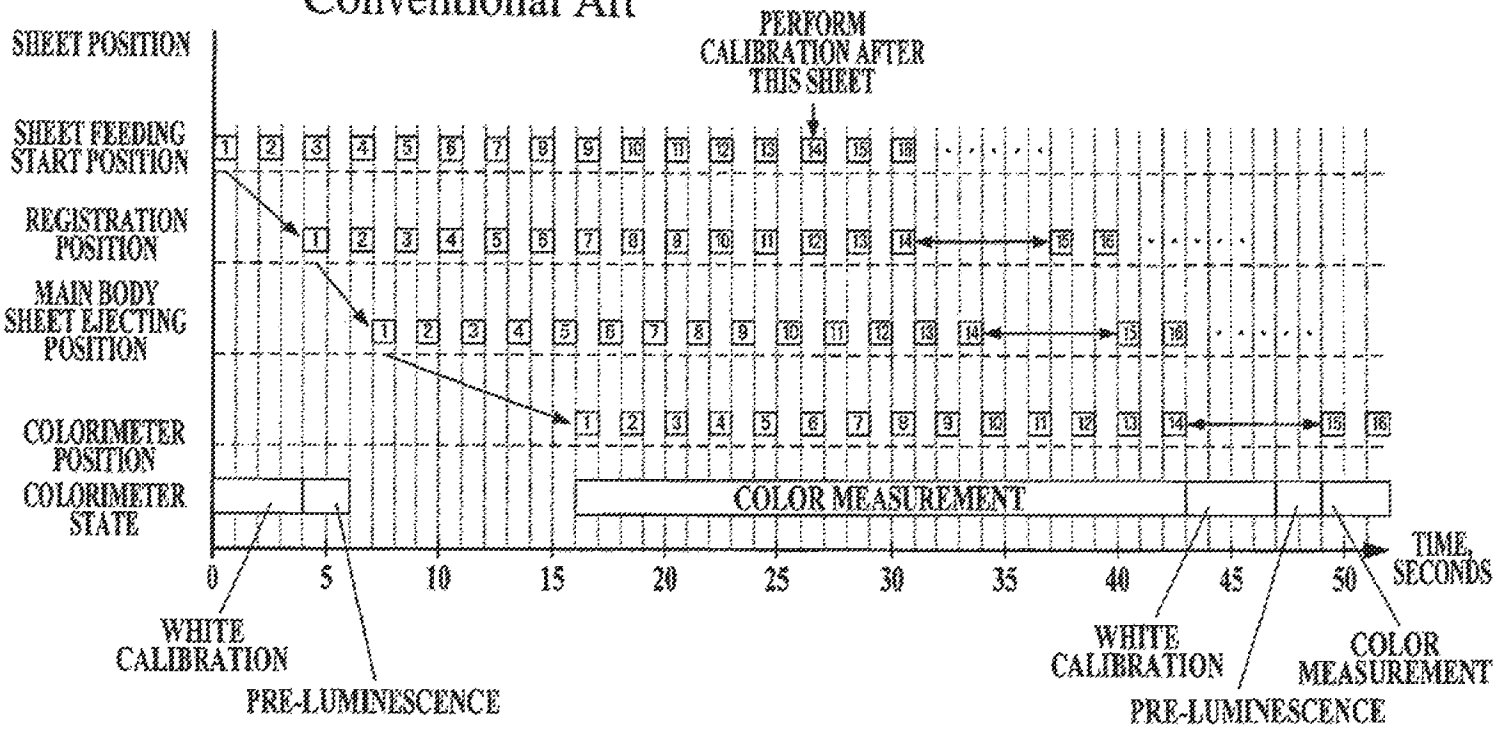
FIG. 12 Conventional Art
FIG. 12 is a conventional processing image showing a state of a conveyed sheet in each position and showing a state of the colorimeter when the color is measured in the image forming system.

FIG. 11 is a processing image showing a state of conveying of the sheet in each position and the state of the colorimeter 23 when the color is measured in the image forming system 100. The number in each position shows the sheet number counted from the first sheet. The horizontal axis shows the amount of time. Here, after the preparation operation (white calibration and pre-luminescence) is finished, the color measurement is possible for 37 seconds. The adjustment in the image forming apparatus 10 is not performed (adjustment time 0 seconds).

In the example shown in FIG. 11, the time necessary to convey the sheet from the sheet feeding start position (sheet feeding tray) of the image forming apparatus 10 to the registration position (registration roller 161) is 4 seconds. This corresponds to the sheet feeding time when the sheet is fed from the sheet feeding trays T1 and T2 (see FIG. 4).

The time necessary to convey the sheet from the registration position to the main body sheet ejecting position (position where the sheet is ejected from the image forming apparatus 10) is 3 seconds. This corresponds to the image forming time on normal sheets or thin sheets (see FIG. 6).

The time necessary to convey the sheet from the main body ejecting position to the position of the colorimeter 23 is 9 seconds. This corresponds to the conveying time when the image reading apparatus 20 is directly connected to the image forming apparatus 10 (see FIG. 7).

Under such conditions (sheet feeding time, image forming time, conveying time) the sheet reaches the position of the colorimeter 23 after 16 seconds from when the first sheet is fed.

When the colorimetric mode is the normal colorimetric mode, since the preparation operation time is 6 seconds (see FIG. 8), the waiting time to start the white calibration from when the first sheet is fed is 10 seconds.

As shown in FIG. 11, by delaying the start of the white calibration in the colorimeter 23 for 10 seconds from when the sheet is fed, the preparation operation (white calibration and pre-luminescence) ends when the first sheet fed from the sheet feeder 15 of the image forming apparatus 10 reaches the position of the colorimeter 23 (16 seconds after the sheet feeding starts), and the colorimeter 23 is able to measure the color.

The colorimeter 23 is able to measure the color for 37 seconds after the preparation operation is finished, and therefore, the color can be measured up to the 19th sheet. In the image forming apparatus 10, since the preparation operation needs to be performed again after the color of the 19th sheet is measured, the image forming apparatus 10 holds the conveying of the 20th sheet for the amount of time necessary for the preparation operation.

As described above, according to the image forming system 100, the timing to start the preparation operation is controlled so that the operation to prepare for color measurement is complete when the first sheet as the target of color measurement reaches the colorimeter 23. Therefore, the productivity can be achieved for predetermined processing (color measurement) which needs to be performed within a certain amount of time after the preparation operation is complete.

Specifically, the timing to start the preparation operation is determined based on the timing that the first sheet reaches the colorimeter 23 and the time necessary to perform the preparation operation. Therefore, it is possible to easily determine the timing to start the preparation operation so that the preparation operation is complete when the first sheet reaches the colorimeter 23.

Moreover, the time necessary to perform processing such as sheet feeding, adjustment, image forming, and conveying after image forming is considered based on the sheet feeding tray used in the image forming apparatus 10, the adjustment type performed in the image forming apparatus 10, the sheet type, and the apparatus connection configuration. With this, it is possible to predict the timing that the first sheet reaches the colorimeter 23.

The description of the present embodiment relates to an example of the image forming system of the present invention, but the present invention is not limited to the above. The detailed configuration and operation of the devices composing the system can be suitably changed without leaving the scope of the present invention.

For example, according to the present embodiment, the image forming system 100 including the image forming apparatus 10 and the image reading apparatus 20 including the colorimeter 23 is described. Alternatively, the colorimeter 23 can be included inside the image forming apparatus 10. In this case, the image forming unit 14, the colorimeter 23, etc. are included inside the image forming apparatus, and the processor 11 of the image forming apparatus 10 controls the timing to start the preparation operation so that the preparation operation ends when the first sheet as the target of color measurement reaches the colorimeter 23.

In the image forming system 100, the waiting time until the preparation operation is started in the image reading apparatus 20 does not have to be calculated by the processor 21 of the image reading apparatus 20. The calculation can be performed by the processor 11 of the image forming apparatus 10 or a processor of an apparatus other than the image reading apparatus 20 or the image forming apparatus 10.

According to the above-described embodiment, the timing that the first sheet reaches the colorimeter 23 is predicted based on the sheet feeding tray, the adjustment type, the sheet type and the apparatus connection configuration. Alternatively, the timing that the first sheet reaches the colorimeter 23 can be predicted based on at least any one of the sheet feeding tray, the adjustment type, the sheet type or the apparatus connection configuration.

According to the present embodiment, the colorimeter 23 is described as the processing device to perform predetermined processing which needs the preparation operation, however, the processing can be other processing which can be performed only within a certain amount of time after the preparation operation is finished.

According to the above-described embodiment, a ROM is used as the computer readable medium storing the program to perform the above processing, but the present invention is not limited to the above. A non-volatile memory such as a flash memory, etc. and a portable recording medium such as a CD-ROM, etc. can be applied as the computer readable medium. A carrier wave can be applied as the medium to provide program data through communication lines.

The present U.S. patent application claims priority under the Paris Convention of Japanese Patent Application No. 2015-190711 filed on Sep. 29, 2015 the entirety of which is incorporated herein by reference.

What is claimed is:

1. An image forming system comprising:

an image forming apparatus which forms an image on a sheet; and a sheet processing apparatus which includes a processing device which performs predetermined processing on a sheet conveyed from the image forming apparatus, wherein, the processing device is able to perform the predetermined processing within a certain amount of time after preparation operation to enable the predetermined processing is completed; and the sheet processing apparatus includes a processor which controls timing to start the preparation operation so that the preparation operation is completed when a first sheet which is to be a target of the predetermined processing reaches the processing device.

2. The image forming system according to claim 1, wherein, the processing device reads an image formed on the sheet conveyed from the image forming apparatus.

3. The image forming system according to claim 2, wherein, the processing device is a colorimeter which measures color of the image formed on the sheet conveyed from the image forming apparatus; and the preparation operation is white calibration on the colorimeter and pre-luminescence of an optical source of the colorimeter.

4. The image forming system according to claim 1, wherein, the processor determines the timing to start the preparation operation based on timing that the first sheet reaches the processing device and amount of time necessary to perform the preparation operation.

5. The image forming system according to claim 4, wherein, the processor predicts the timing that the first sheet reaches the processing device based on at least one of a sheet feeding tray used in the image forming apparatus, a type of adjustment performed in the image forming apparatus, a sheet type or an apparatus connection configuration.

6. An image forming apparatus comprising:

an image forming unit which forms an image on a sheet;

a processing device which performs predetermined processing on a sheet conveyed from the image forming unit, and which is able to perform the predetermined processing only within a certain amount of time after preparation operation to enable the predetermined processing is completed; and a processor which controls timing to start the preparation operation so that the preparation operation is complete when a first sheet which is to be a target of the predetermined processing reaches the processing device.

7. A non-transitory computer-readable storage medium having a program stored thereon for controlling a computer used in a sheet processing apparatus which includes a processing device which performs predetermined processing on a sheet conveyed from an image forming apparatus which forms an image on a sheet, the program, when being executed by a processor of the computer, causing the processor to perform process comprising:

controlling timing to start a preparation operation to enable the predetermined processing so that the preparation operation is completed when a first sheet which is to be a target of the predetermined processing reaches the processing device; and wherein the processing device is able to perform the predetermined processing within a certain amount of time after the preparation operation is completed.

8. The storage medium according to claim 7, wherein, the processing device reads an image formed on the sheet conveyed from the image forming apparatus.

9. The storage medium according to claim 8, wherein, the processing device is a colorimeter which measures color of the image formed on the sheet conveyed from the image forming apparatus; and the preparation operation is white calibration on the colorimeter and pre-luminescence of an optical source of the colorimeter.

10. The storage medium according to claim 7, wherein, the processor determines the timing to start the preparation operation based on timing that the first sheet reaches the processing device and amount of time necessary to perform the preparation operation.

11. The storage medium according to claim 10, wherein, the processor predicts the timing that the first sheet reaches the processing device based on at least one of a sheet feeding tray used in the image forming apparatus, a type of adjustment performed in the image forming apparatus, a sheet type or an apparatus connection configuration.

12. A non-transitory computer-readable storage medium having a program stored thereon for controlling a computer used in an image forming apparatus which includes an image forming unit which forms an image on a sheet; and a processing device which performs predetermined processing on a sheet conveyed from the image forming unit, the program, when being executed by a processor of the computer, causing the processor to perform process comprising:

controlling timing to start a preparation operation to enable the predetermined processing so that the preparation operation is completed when a first sheet which is to be a target of the predetermined processing reaches the processing device; and wherein the processing device is able to perform the predetermined processing within a certain amount of time after the preparation operation is completed.

* * * * *